US006551069B2

(12) United States Patent
Narney, II et al.

(10) Patent No.: US 6,551,069 B2
(45) Date of Patent: Apr. 22, 2003

(54) COMPRESSOR WITH A CAPACITY MODULATION SYSTEM UTILIZING A RE-EXPANSION CHAMBER

(75) Inventors: John K. Narney, II, Bristol, VA (US); David T. Monk, Bristol, VA (US); Joseph F. Loprete, Bristol, TN (US)

(73) Assignee: Bristol Compressors, Inc., Bristol, VA (US)

( * ) Notice: Subject to any disclaimer, the term of this patent is extended or adjusted under 35 U.S.C. 154(b) by 3 days.

(21) Appl. No.: 09/877,146

(22) Filed: Jun. 11, 2001

(65) Prior Publication Data

US 2002/0187050 A1 Dec. 12, 2002

(51) Int. Cl.[7] ..... F04B 19/24; F04B 49/00

(52) U.S. Cl. ..... 417/53; 417/310; 417/283; 417/299

(58) Field of Search ..... 417/53, 310, 283; 412/299

(56) References Cited

U.S. PATENT DOCUMENTS

| | | | | | |
|---|---|---|---|---|---|
| 2,904,973 | A | | 9/1959 | Kosfeld | 62/324 |
| 2,991,931 | A | | 7/1961 | Galin | 230/145 |
| 3,023,590 | A | | 3/1962 | Playle | 62/196 |
| 3,031,861 | A | | 5/1962 | McCormack | 62/196 |
| 3,767,328 | A | * | 10/1973 | Ladusaw | 417/283 |
| 4,065,229 | A | | 12/1977 | Black | 417/270 |
| 4,076,461 | A | | 2/1978 | Moody, Jr. et al. | 417/310 |
| 4,344,297 | A | | 8/1982 | Ueno et al. | 62/196 |
| 4,373,352 | A | | 2/1983 | Ladusaw | 62/196 |
| 4,389,168 | A | | 6/1983 | Yannascoli et al. | 417/298 |
| 4,410,299 | A | | 10/1983 | Shimoyama | 417/440 |
| 4,431,388 | A | | 2/1984 | Eber et al. | 418/55 |
| 4,480,965 | A | | 11/1984 | Ishizuka | 417/274 |
| 4,522,038 | A | * | 6/1985 | Ozu | 417/299 |
| 4,558,993 | A | * | 12/1985 | Hori et al. | 417/283 |
| 4,664,608 | A | * | 5/1987 | Adams et al. | 417/299 |
| 4,685,489 | A | | 8/1987 | Yun et al. | 137/543.15 |
| 4,694,660 | A | | 9/1987 | Gannaway | 62/196.4 |
| 4,838,740 | A | * | 6/1989 | Watanabe et al. | 417/295 |
| 5,049,040 | A | | 9/1991 | Diab et al. | 417/274 |
| 5,333,999 | A | | 8/1994 | Sakakura et al. | 417/309 |
| 5,385,453 | A | | 1/1995 | Fogt et al. | 417/410.5 |
| 5,518,381 | A | | 5/1996 | Matsunaga et al. | 418/100 |
| 5,551,846 | A | | 9/1996 | Taylor et al. | 417/308 |
| 5,591,014 | A | | 1/1997 | Wallis et al. | 417/310 |
| 5,611,674 | A | | 3/1997 | Bass et al. | 417/220 |
| 5,613,841 | A | | 3/1997 | Bass et al. | 417/310 |
| 5,641,279 | A | | 6/1997 | Yamamoto | 418/66 |
| 5,678,985 | A | | 10/1997 | Brooke et al. | 417/299 |
| 5,741,120 | A | | 4/1998 | Bass et al. | 417/44.2 |
| 5,823,755 | A | * | 10/1998 | Wilson et al. | 418/15 |
| 6,042,344 | A | | 3/2000 | Lifson | 417/310 |
| 6,047,556 | A | | 4/2000 | Lifson | 62/196.2 |
| 6,079,952 | A | | 6/2000 | Harte et al. | 417/53 |

FOREIGN PATENT DOCUMENTS

| | | |
|---|---|---|
| DE | 362768 | 11/1922 |

* cited by examiner

*Primary Examiner*—Charles G. Freay
*Assistant Examiner*—Michael K. Gray
(74) *Attorney, Agent, or Firm*—Finnegan, Henderson, Farabow, Garrett & Dunner, L.L.P.

(57) ABSTRACT

A compressor with a capacity modulation system includes a compression chamber, a rotatable shaft within the compression chamber, and a roller mounted on the shaft in contact with a wall of the compression chamber. A suction channel is in fluid communication with the compression chamber for providing fluid at a suction pressure and a discharge channel is in fluid communication with the compression chamber for removing fluid at a discharge pressure. A re-expansion channel adjacent to the compression chamber has a first end forming a re-expansion port in the wall of the compression chamber. A re-expansion chamber is connected to the re-expansion channel. A valve disposed in the re-expansion channel is movable between a first position, in which the valve allows fluid communication between the compression chamber and the re-expansion chamber, and a second position, in which the valve prevents fluid communication between the compression chamber and re-expansion chamber.

52 Claims, 6 Drawing Sheets

COMPRESSOR WITH A CAPACITY MODULATION SYSTEM UTILIZING A RE-EXPANSION CHAMBER

BACKGROUND OF THE INVENTION

1. Field of the Invention

The present invention relates to a compressor with a capacity modulation system and, more particularly, to a rotary compressor with a capacity modulation system utilizing a re-expansion chamber.

2. Description of the Related Art

Capacity modulation of compressors is known in the art. In a capacity modulated compressor, the output is varied in proportion to the demand placed on it. In refrigeration systems and in heating, ventilation, and air conditioning (HVAC) systems with compressors, capacity modulation is used to reduce energy consumption and increase system reliability. These systems also use capacity modulated compressors to more precisely control environmental parameters in the conditioned space, such as temperature, humidity, air flow noise, and equipment noise.

A conventional technique for modulating the capacity of a compressor, in particular a rotary compressor, involves controlling the speed of the compressor motor using a variable speed inverter.

There are a number of problems associated with conventional capacity modulation systems. Variable speed inverters are expensive and unreliable. These inverters rely on complex electronics that are costly to produce and prone to failure. Further, due to the complexity of inverter-driven compressor systems, highly trained technicians are required to service them.

SUMMARY OF THE INVENTION

To overcome the drawbacks of the prior art and in accordance with the purpose of the invention, as embodied and broadly described herein, one aspect of the invention provides a rotary compressor including a compression chamber, a suction port for providing fluid at a suction pressure to the compression chamber, a roller within the compression chamber for compressing fluid in the compression chamber, and a discharge port for removing fluid at a discharge pressure from the compression chamber. The compressor further includes a re-expansion chamber and a re-expansion port positioned between the suction port and the discharge port. The re-expansion port provides a flow path between the compression chamber and the re-expansion chamber. A valve device associated with the re-expansion port allows or prevents fluid communication between the compression chamber and the re-expansion chamber.

In another aspect, the invention provides a rotary compressor, including a compression chamber, a rotatable shaft disposed within the compression chamber, and a roller disposed on the shaft in contact with a wall of the compression chamber. A partition contacts the wall of the compression chamber and the roller, the partition defining a low pressure portion and a high pressure portion within the compression chamber. A suction channel is in fluid communication with the low pressure portion for providing fluid to the compression chamber at a suction pressure and a discharge channel is in fluid communication with the high pressure portion for removing fluid from the compression chamber at a discharge pressure. The compressor further includes a re-expansion port in the wall of the compression chamber and a re-expansion chamber connected to the re-expansion port.

In a further aspect, the invention provides a rotary compressor with a capacity modulation system, the compressor including a substantially cylindrical compression chamber, a rotatable shaft disposed within the compression chamber, a roller eccentrically disposed on the shaft in contact with a wall of the compression chamber, and a vane disposed between the wall of the compression chamber and the roller, the vane defining a low pressure portion and a high pressure portion within the compression chamber. A suction channel is in fluid communication with the low pressure portion for providing fluid to the compression chamber at a suction pressure and a discharge channel is in fluid communication with the high pressure portion for removing fluid from the compression chamber at a discharge pressure. A re-expansion channel is adjacent to the compression chamber, the re-expansion channel having an end forming a re-expansion port in the wall of the compression chamber. A re-expansion chamber is connected to the re-expansion channel. The compressor further includes a valve disposed in the re-expansion channel movable between a first position, in which the valve allows fluid communication between the compression chamber and the re-expansion chamber, and a second position, in which the valve prevents fluid communication between the compression chamber and the re-expansion chamber.

In yet another aspect, the invention provides a method of modulating the capacity of a rotary or swing link compressor including a compression chamber and a rotary compressing member in the compression chamber. The method includes supplying fluid to the compression chamber through an inlet port, providing the compressor with a re-expansion chamber, and providing a flow path between the compression chamber and the re-expansion chamber. The flow path is positioned at a location spaced from the inlet port. The method further includes operating the compressor in a reduced capacity mode, including opening the flow path, compressing fluid in the compression chamber and the re-expansion chamber, withdrawing compressed fluid from the compression chamber through a discharge port, and allowing compressed fluid in the re-expansion chamber to return to the compression chamber. The method further includes supplying additional fluid to the compression chamber through the inlet port and operating the compressor in a full capacity mode, including closing the flow path, compressing the fluid in the compression chamber, and withdrawing the compressed fluid from the compression chamber through the discharge port.

Additional advantages of the invention will be set forth in part in the description that follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION OF THE INVENTION

Reference will now be made in detail to the present embodiments of the invention, examples of which are illustrated in the accompanying drawings. Wherever possible, the same reference numbers will be used throughout the drawings to refer to the same or like parts.

Figure 1:
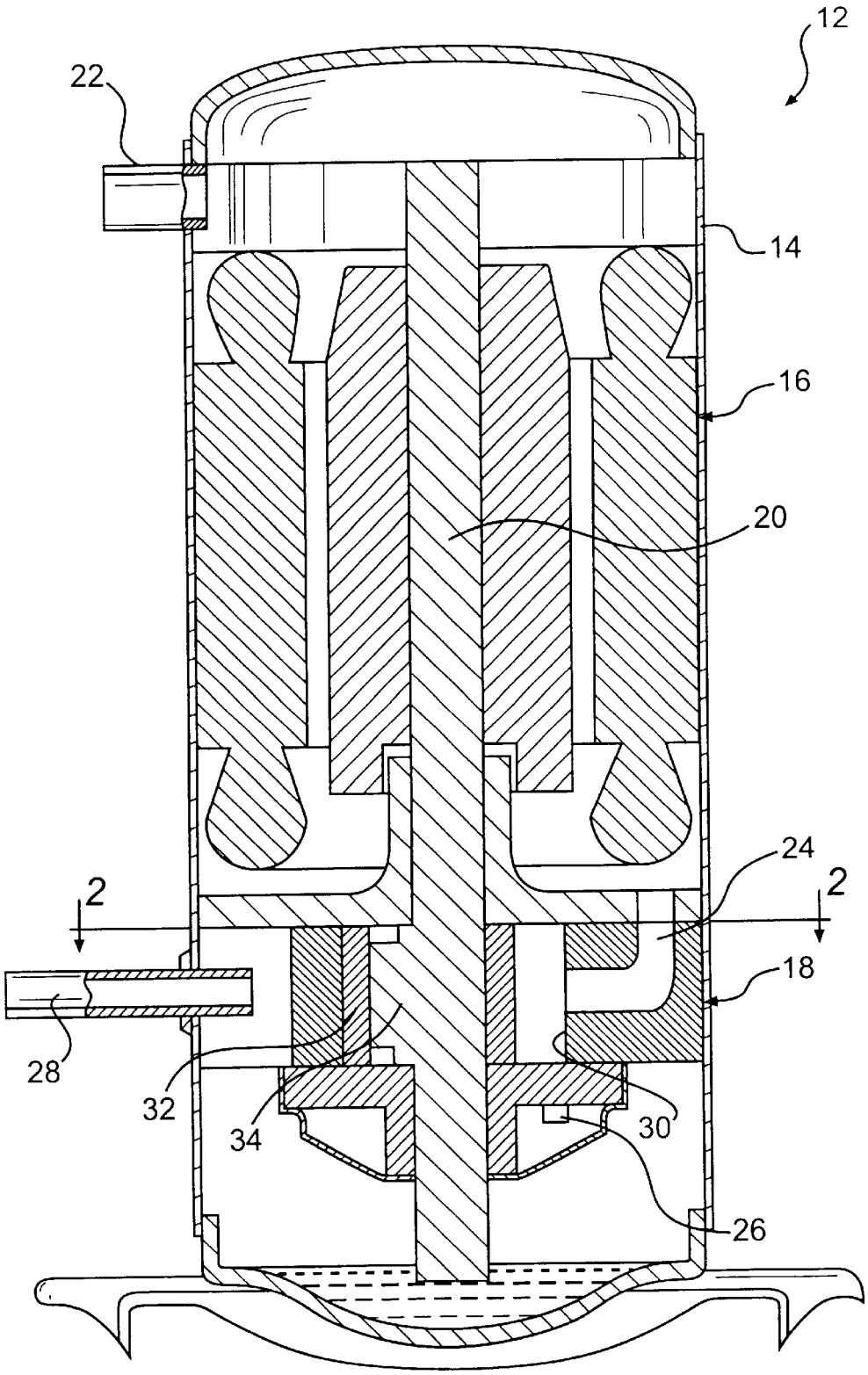
FIG. 1 is a sectional view of a compressor incorporating the capacity modulation system of the present invention.

The capacity modulation system 10 of the present invention will be described with reference to a rotary or swing-link compressor 12 of the type used in HVAC and refrigeration systems. It is understood, however, that the capacity modulation system could be effectively applied in compressors operating in other environments as well. As shown in FIG. 1, the compressor 12 includes a housing 14, a motor 16, and a rotary compressor unit 18. The motor 16 turns a shaft 20, which operates the compressor unit 18.

In operation, the compressor unit 18 draws fluid, such as refrigerant, into the housing 14 through an inlet 22 at suction pressure. In the compressor shown in FIG. 1, the inlet is proximate to the motor 16, and the refrigerant cools the motor 16 as it flows to the compressor unit 18. Alternatively, the inlet 22 can be positioned proximate to the compressor unit 18 in such a manner that the refrigerant does not flow past the motor 16, but instead is applied directly to the compressor unit 18.

The fluid then passes through the suction channel 24 and enters the compressor unit 18, where it is compressed. The compressed fluid leaves the compressor unit 18 at discharge pressure through the discharge channel 26, then passes out of the housing 14 through the outlet 28.

The fluid is compressed within the compressor unit 18 in a substantially cylindrical compression chamber 30 shown in FIGS. 2–5. The rotatable shaft 20 is disposed within the compression chamber 30. A cylindrical roller or piston 32 is eccentrically disposed on the shaft 20 within the compression chamber 30 such that it contacts a wall of the compression chamber 30 as the shaft 20 rotates. The roller 32 is free to rotate on an eccentric or crank 34 that is secured to or integral with the shaft 20. The roller or piston 32 can be any of the types used in conventional rotary or swing link compressors.

In the rotary compressor shown in FIGS. 2–5, a partition, or vane 36, is disposed between the wall of the compression chamber 30 and the roller 32 to define a low pressure portion 38 and a high pressure portion 40 within the compression chamber 30. As the shaft 20 and the roller 32 rotate from the position shown in FIG. 2, the low pressure portion 38 increases in size as the high pressure portion 40 decreases in size. As a result, the fluid in the high pressure portion 40 is compressed and exits through the discharge port 44.

The vane 36 must be kept in close contact with the roller 32 as the roller 32 moves along the circumference of the compression chamber 30 to insure that the fluid being compressed does not leak back to the low pressure portion 38. The vane 36 can be spring biased towards the roller 32, allowing the vane 36 to follow the roller 32 as it moves. Alternatively, the vane 36 can be integral with the roller 32. Compressors having an integral vane and roller are known as "swing link" compressors.

The suction channel 24, shown in FIGS. 1–5, is in fluid communication with the low pressure portion 38 to provide fluid to the compression chamber 30 at suction pressure. As shown in FIGS. 2–5, the suction channel 24 forms a suction inlet or port 42 in the wall of the compression chamber 30 adjacent to the vane 36 in the low pressure portion 38.

The discharge channel 26, shown in FIGS. 1–5, is in fluid communication with the high pressure portion 40 to remove fluid from the compression chamber 30 at discharge pressure. The discharge channel 26 forms a discharge outlet or port 44 in the wall of the compression chamber 30 adjacent to the vane 36 in the high pressure portion 40, as shown in FIGS. 2–5.

Two embodiments of the capacity modulation system 10 of the present invention are shown in FIGS. 2–5. In both embodiments, a re-expansion chamber 50 is provided adjacent to the compression chamber 30, with a re-expansion channel 46 providing a flow path between the compression chamber 30 and the re-expansion chamber 50. The re-expansion channel 46 forms a re-expansion port 48 in the wall of the compression chamber.

The re-expansion chamber 50 can be arranged in locations proximate to the compression chamber 30 and is sized to provide a desired modulation of the compressor capacity, as explained in more detail below. By means of example only, the re-expansion chamber 50 can be machined as a recess in the cylinder block opposite the compression chamber 30 and connected with the compression chamber 30 by a drilled channel. The open recess can then be enclosed by a cap of the compressor, to provide a sealed re-expansion chamber 50.

As shown in FIGS. 2–5, the re-expansion chamber 50 is connected with a portion of the re-expansion channel 46. Further, a valve 52 is disposed in the re-expansion channel 46. The valve 52 is movable between a first position, shown in FIGS. 2 and 4, and a second position, shown in FIGS. 3 and 5.

In the first position, the valve 52 allows fluid to flow between the compression chamber 30 and the re-expansion chamber 50. As described below, the compressor 12 operates in a reduced capacity mode when the valve 52 is in the first position. In the second position, the valve 52 prevents fluid communication between the compression chamber 30 and the re-expansion chamber 50. As described below, the compressor 12 operates in a full capacity mode when the valve 52 is in the second position. Thus, the valve 52 selectively allows or prevents fluid communication between the compression chamber 30 and the re-expansion chamber 50.

Figure 2:
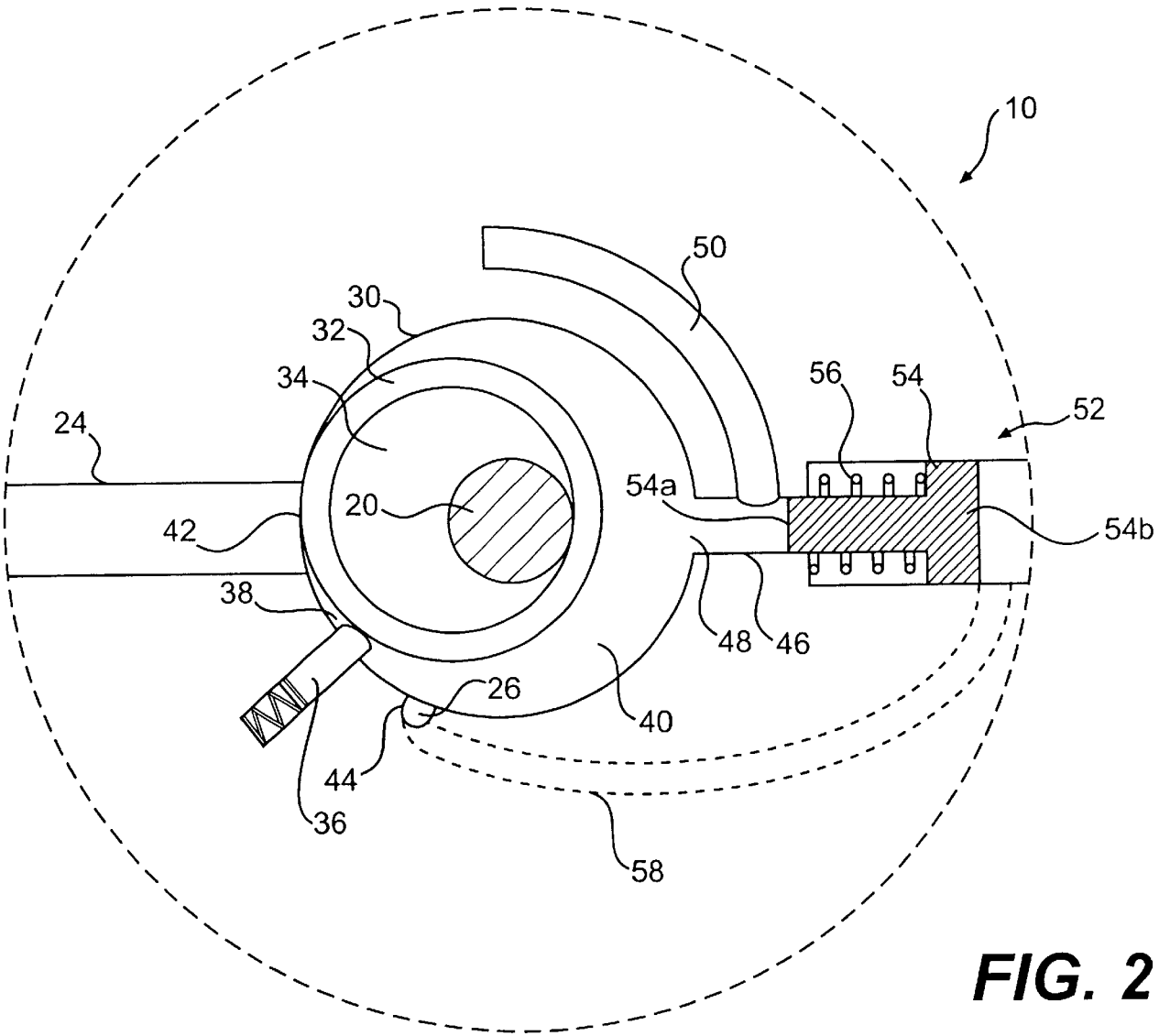
FIG. 2 is a partial sectional view on line 2—2 of FIG. 1, showing one embodiment of the capacity modulation system of the present invention in a reduced capacity mode.
Figure 3:
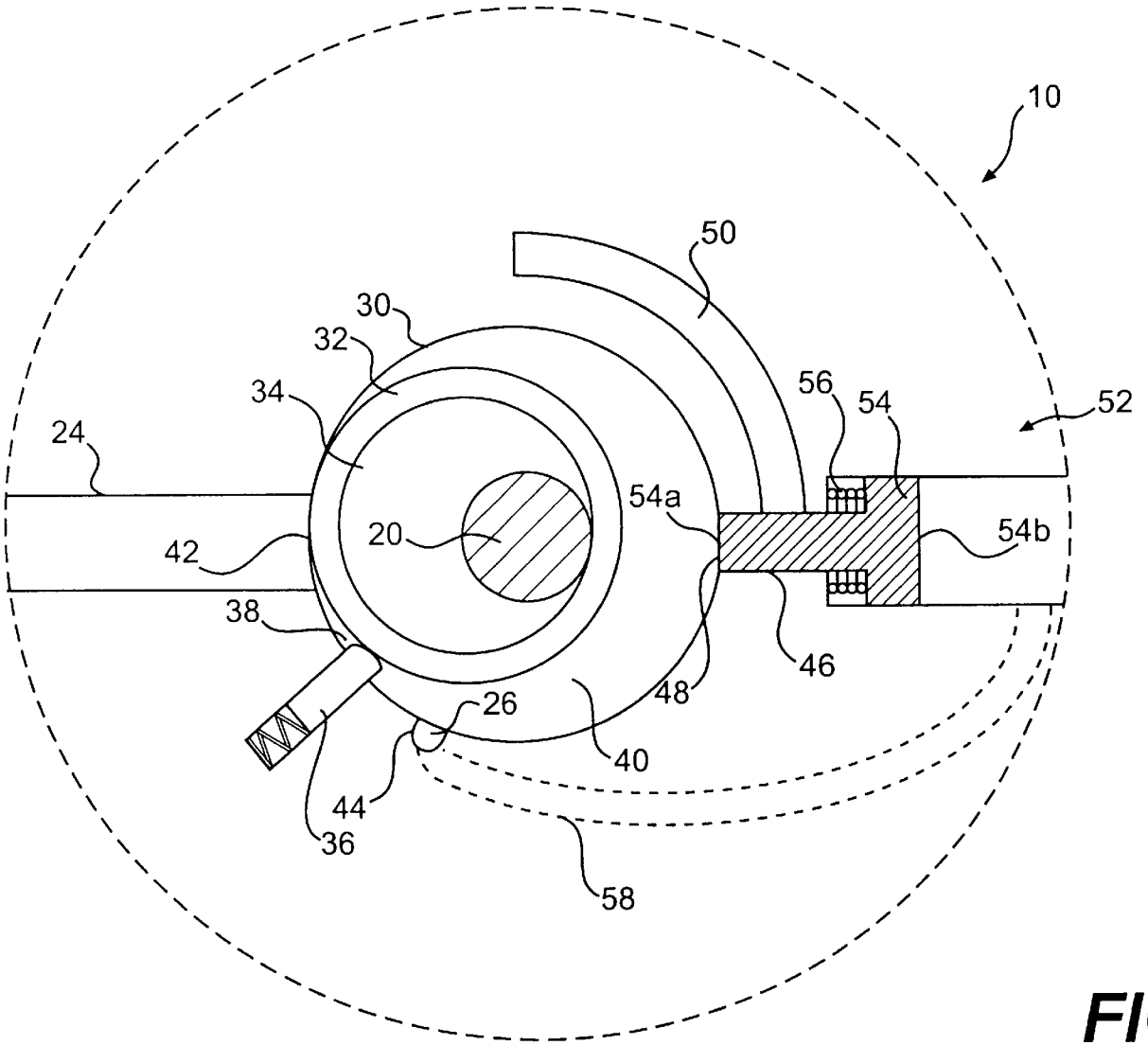
FIG. 3 is a partial sectional view on line 2—2 of FIG. 1, showing the same embodiment of the capacity modulation system of the present invention in a full capacity mode.

In the embodiment of the capacity modulation system 10 shown in FIGS. 2 and 3, the valve 52 comprises a sliding element 54 biased to the first position by a coil spring 56. The sliding element 54 has a forward surface 54*a* and a rear surface 54*b*. A discharge feed line 58 extends from the discharge channel 26 to the re-expansion channel 46 to expose the rear surface 54*b* of the sliding element 54 to fluid at discharge pressure.

When the compressor 12 is initially activated, it is in the reduced capacity mode shown in FIG. 2. The compression cycle begins as fluid enters the low pressure portion 38 of the compression chamber 30 through the suction channel 24 in advance of the roller 32.

As the roller 32 proceeds along the inner circumference of the compression chamber 30, the fluid is compressed. Some of this compressed fluid flows through the re-expansion port 48, along the re-expansion channel 46, and into the re-expansion chamber 50. When the roller 32 passes the re-expansion port 48, the fluid in the re-expansion chamber 50 expands back to the low pressure portion 38 of the compression chamber 30. Some of this fluid flows back through the suction port 42 into the suction channel 24 until the fluid is at or close to the suction pressure. The remaining fluid in the high pressure portion 40 is further compressed until it is discharged from the compression chamber 30 through the discharge port 44.

Thus, in this mode, not all of the fluid that enters the compression chamber 30 exits through the discharge port 44. A certain volume of fluid, which is dependent upon the volume of the re-expansion chamber 50, is allowed to return to the compression chamber 30. Because not all of the fluid exits the compressor 12, this operational mode is referred to as the reduced capacity mode.

The degree of capacity reduction is determined by a variety of factors, including the volume of the re-expansion chamber 50 and the location of the re-expansion port 48 relative to the suction port 42. Generally, increasing the volume of the re-expansion chamber 50 provides a greater reduction in the capacity of the compressor 12. Similarly, locating the re-expansion port 48 farther from the suction port 42 along the roller's path also provides a greater reduction in capacity. Ultimately, the optimum volume of the re-expansion chamber 50 and location of the re-expansion port 42 for a given application can be determined by a combination of analytical calculations and empirical testing.

Referring again to FIG. 2, as the compressor 12 continues to operate, the discharge pressure slowly increases. The force of the fluid on the rear surface 54*b* of the sliding element 54 acts against the biasing force of the spring 56. Eventually, the discharge pressure reaches a predetermined level and overcomes the spring force, causing the sliding element 54 to move to the second position, corresponding to the full capacity mode of the compressor 12. The predetermined discharge pressure level can be varied by using a biasing means having a different spring constant. The valve 52 of this embodiment, therefore, operates in response to a parameter internal to the compressor 12. Again, the design of the valve 52 and the selection of a spring 56 for a specific system can be determined through empirical testing.

FIG. 3 shows the compressor 12 of this embodiment in the full capacity mode. As shown, the forward surface 54*a* of the sliding element 54 is substantially flush with the wall of the compression chamber 30. Here, as the roller 32 proceeds around the compression chamber 30, all of the fluid in the low pressure section 38 is compressed until it is discharged through the discharge port 44. Thus, in the full capacity mode, each compression stroke of the roller 32 produces a larger volume of high pressure fluid. In this embodiment, the rotary or swing link compressor will operate at the full capacity, in the same manner as conventional rotary and swing link compressors.

Although the valve 52 of this embodiment has been described as being a piston-type valve 52 biased with a coil spring 56, it is noted that other equivalent valve members and biasing devices are considered within the scope of the invention. Examples of suitable biasing means include torsion springs, coil springs, and other springs and elastic elements.

Figure 4:
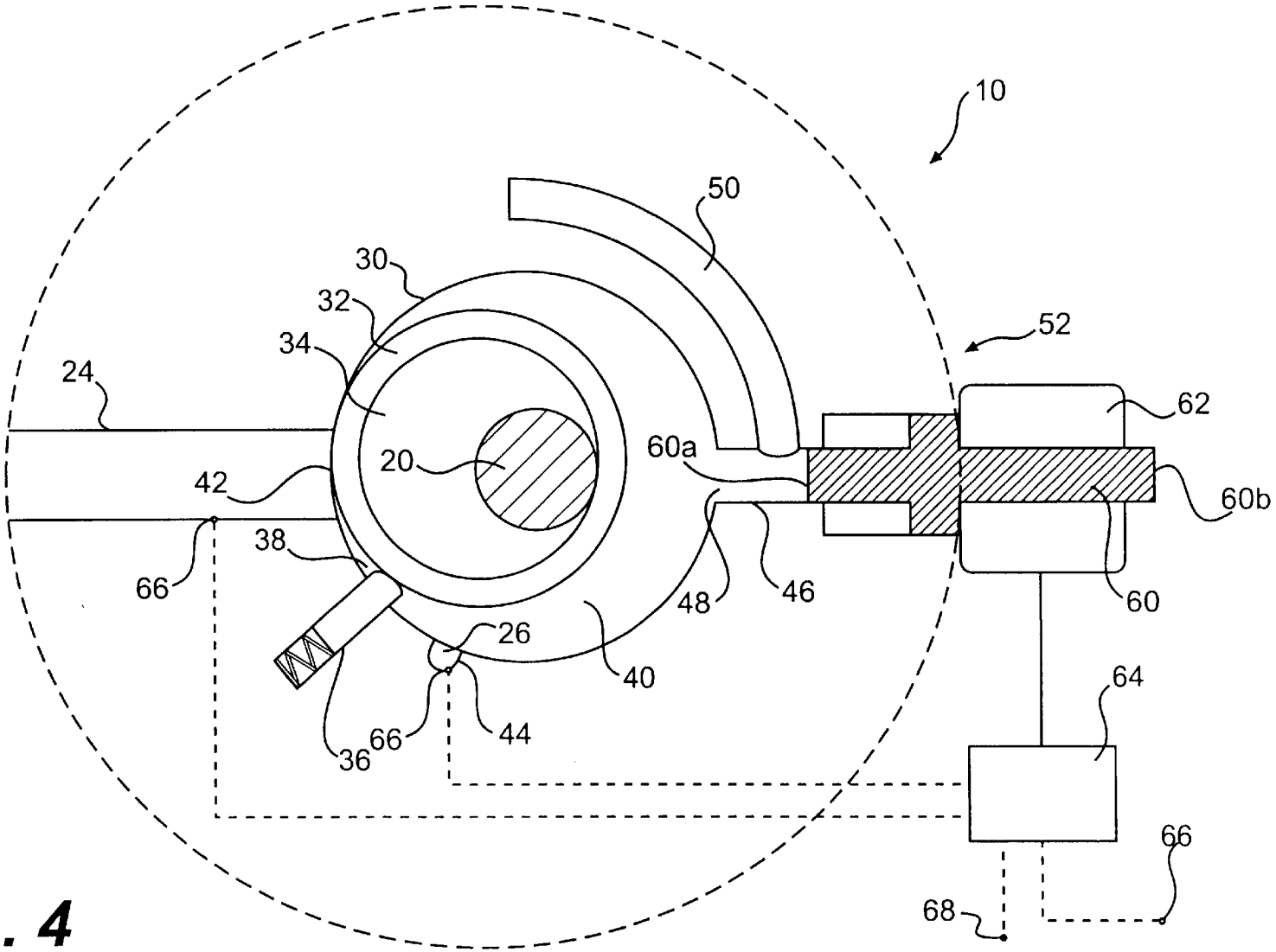
FIG. 4 is a partially schematic partial sectional view on line 2—2 of FIG. 1, showing another embodiment of the capacity modulation system of the present invention in a reduced capacity mode.
Figure 5:
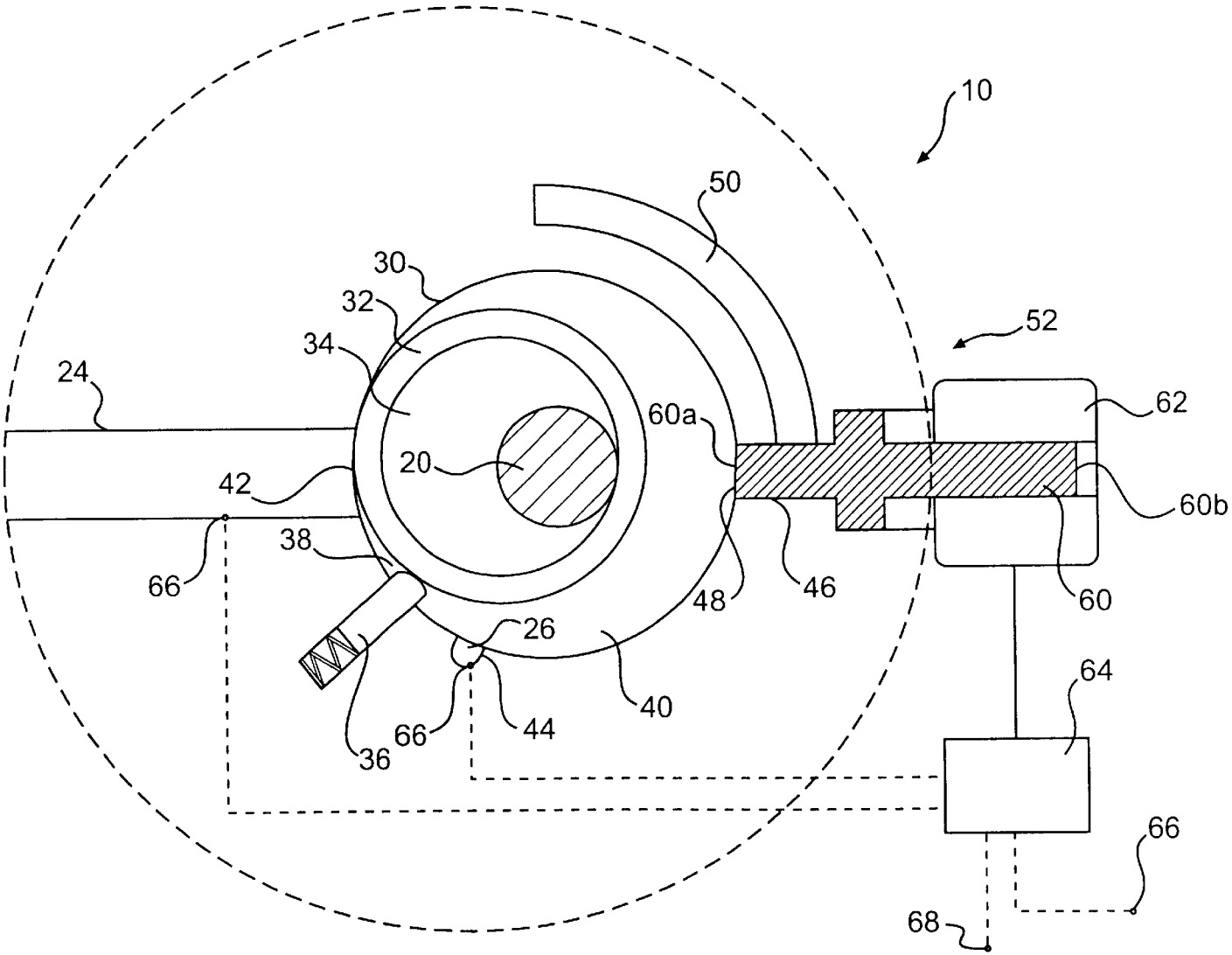
FIG. 5 is a partially schematic partial sectional view on line 2—2 of FIG. 1, showing the same embodiment of the capacity modulation system of the present invention in a full capacity mode.

In another embodiment, shown in FIGS. 4 and 5, the valve 52 comprises a valve element controlled to open or close in response to a control signal. For example, in FIGS. 4 and 5 the valve includes a sliding element 60 engaged by a solenoid 62. The sliding element 60 has a forward surface 60*a* and a rear surface 60*b*. The solenoid 62 is actuated to move the sliding element 60 in response to a control signal received from a control device 64. The control device 64 generates the control signal based on input received from one or more sensors 66 located internal or external to the compressor 12. The valve actuator has been described as a solenoid, but other equivalent actuators, including pneumatic and hydraulic actuators, are considered within the scope of the invention.

As shown in FIGS. 4 and 5, the internal sensors 66 can be located in the suction channel 24 and/or the discharge channel 26. For example, the sensors 66 can be pressure sensors, and the control device 64 can cause the solenoid to move the valve 52 to the closed position when the discharge pressure or the pressure differential reaches a predetermined value. Other sensor locations internal to the compressor 12 are considered within the scope of the invention.

Sensors external to the compressor 12 can be located in an any suitable location to measure a desired parameter. One external sensor 66 is shown schematically in FIGS. 4 and 5.

Sensors can be used to measure all types of parameters internal and external to the compressor 12. Examples of parameters internal to the compressor 12 are flow rate, fluid temperature, and fluid pressure. External parameters include air temperature, equipment temperature, humidity, and noise. Typical control devices used to generate control signals are thermostats, humidistats, and other equivalent devices. Other internal and external parameters and control devices are within the scope of the invention. The control device 64 receives input from the sensors 66 and, guided by internal software or control specifications, actuates the valve 52 to operate the compressor 12 in the full capacity mode or reduced capacity mode to provide optimum capacity at given sensed conditions.

FIG. 4 shows the compressor 12 of this embodiment in the reduced capacity mode. As described above, when the compressor 12 is operated in this mode, a portion of the fluid is compressed into the re-expansion chamber 50 during each compression cycle. When the roller 32 passes the re-expansion port 48, the fluid in the re-expansion chamber 50 expands back to the low pressure section 38 of the compression chamber 30. The remaining fluid in the high pressure section 40 is further compressed until it is discharged from the compression chamber 30 through the discharge port 44.

The compressor 12 operates in the reduced capacity mode until an internal or external parameter is reached, according to the input from one or more sensors 66. In response to the sensor input, the control device 64 generates a control signal to actuate the solenoid 62. When the solenoid 62 is actuated, it moves the sliding element 60 from the first position to the second position, thereby putting the compressor 12 into the full capacity mode. The valve 52 of this embodiment, therefore, operates in response to a parameter internal or external to the compressor 12.

FIG. 5 shows the compressor 12 of this embodiment in the full capacity mode. As shown, the forward surface 60*a* of the sliding element 60 is substantially flush with the wall of the compression chamber 30. As the roller 32 proceeds around the compression chamber 30, all of the fluid in the low pressure section 38 is compressed until it is discharged through the discharge port 44. Thus, in the full capacity mode, each compression stroke of the roller 32 produces a larger volume of high pressure fluid.

The capacity modulation system 10 of this embodiment may also be utilized so that the compressor 12 begins operation in the full capacity mode and transitions to the reduced capacity mode in response to the measurement of an internal or external parameter.

In an alternative embodiment, the valve 52 can be manually controlled using a switch 68 connected to the control device 64, as shown in FIGS. 4 and 5. With the switch 68, a user can change the operational mode of the compressor 12 between the full capacity mode and the reduced capacity mode, as desired.

Although the valves 52 of the above-described embodiments have been described as comprising a sliding element 54, 60, a variety of other mechanisms can be applied according to the principles of the present invention. Examples of suitable valves include ball valves, gate valves, globe valves, butterfly valves, and check valves. These valves can be positioned along the re-expansion channel 46 between the compression chamber 30 and the re-expansion chamber 50. Further, the valves can be designed to open and permit fluid flow between the chambers when the compressor 12 is to be operated in the reduced capacity mode, and to close and prevent, or significantly limit, flow when the compressor 12 is to be operated in the full capacity mode.

The embodiments discussed above provide a rotary or swing link compressor with a dual capacity. However, the principles of the invention can be applied to provide a compressor 12 having three or more differential capacities by providing more than one re-expansion chamber 50.

Figure 6:
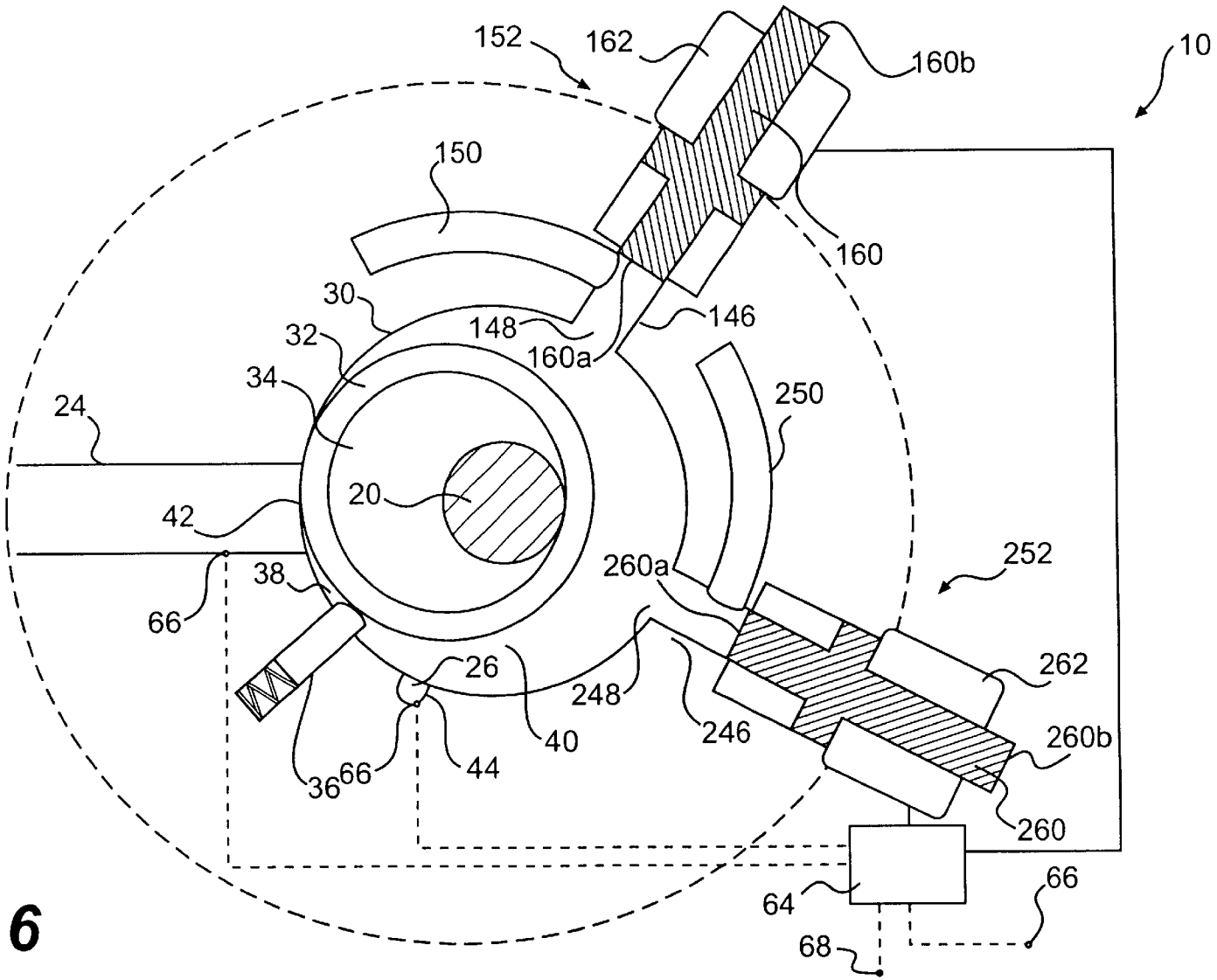
FIG. 6 is a partially schematic partial sectional view on line 2—2 of FIG. 1, showing yet another embodiment of the capacity modulation system of the present invention in a reduced capacity mode.

In a further embodiment of the capacity modulation system 10 of the present invention shown in FIG. 6, two separate re-expansion chambers 150, 250 and re-expansion channels 146, 246 are provided to selectively communicate with the compression chamber 30 under desired conditions. In this embodiment, the general elements and valve systems described above are used for each re-expansion chamber 150, 250.

In operation, the control device 64 of this embodiment opens both valves 152, 252 to allow flow between the compression chamber 30 and both re-expansion chambers 150, 250 to operate the compressor at a maximum level of capacity reduction. Two intermediate levels of capacity reduction are achieved by selectively opening the first valve 152 and closing the second valve 252, then closing the first valve 152 and opening the second valve 252. When both valves 152, 252 are closed, the compressor 12 operates at full capacity. The control device 64 can select the proper valve configuration to optimize the operation of the compressor 12 under a given set of conditions. Alternatively, as shown in FIG. 6, a switch 68 may be provided to allow manual control over the capacity of the compressor 12. Compressors utilizing more than two re-expansion chambers are considered within the scope of the invention.

In a further embodiment, a portion of a single re-expansion chamber can be designed so that the volume exposed to the compressed fluid can be varied by valves or other means.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A rotary compressor, comprising:

a compression chamber;

a suction port for providing fluid at a suction pressure to the compression chamber;

a roller within the compression chamber for compressing fluid in the compression chamber;

a discharge port for removing fluid at a discharge pressure from the compression chamber;

a closed-ended re-expansion chamber;

a re-expansion port positioned between the suction port and the discharge port, the re-expansion port providing a flow path between the compression chamber and the re-expansion chamber; and a valve device associated with the re-expansion port to allow or prevent fluid communication between the compression chamber and the re-expansion chamber.

2. The rotary compressor of claim 1, wherein the valve device operates in response to a parameter internal to the compressor.

3. The rotary compressor of claim 2, wherein the parameter is fluid pressure.

4. The rotary compressor of claim 3, wherein the fluid pressure is the discharge pressure of the compressor.

5. The rotary compressor of claim 3, wherein the fluid pressure is the suction pressure of the compressor.

6. The rotary compressor of claim 1, wherein the valve device operates in response to a parameter external to the compressor.

7. The rotary compressor of claim 6, wherein the parameter is temperature.

8. The rotary compressor of claim 1, wherein the valve device comprises a movable element biased to a first position, in which the movable element allows fluid communication between the compression chamber and the re-expansion chamber.

9. The rotary compressor of claim 8, further comprising:

a flow channel between the discharge channel and a surface of the movable element, wherein fluid at the discharge pressure from the discharge channel applies a force on the surface of the movable element tending to move the movable element to a second position, in which the movable element prevents fluid communication between the compression chamber and the re-expansion chamber.

10. The rotary compressor of claim 1, wherein the valve device is an electrically actuated valve.

11. A rotary compressor, comprising:

a compression chamber;

a suction port for providing fluid at a suction pressure to the compression chamber;

a roller within the compression chamber for compressing fluid in the compression chamber;

a discharge port for removing fluid at a discharge pressure from the compression chamber;

a re-expansion chamber;

a re-expansion port positioned between the suction port and the discharge port, the re-expansion port providing a flow path between the compression chamber and the re-expansion chamber;

a valve device associated with the re-expansion port to allow or prevent fluid communication between the compression chamber and the re-expansion chamber;

a second re-expansion chamber;

a second re-expansion port positioned between the suction port and the discharge port, the second re-expansion port providing a flow path between the compression chamber and the second re-expansion chamber; and a valve device associated with the second re-expansion port to allow or prevent fluid communication between the compression chamber and the second re-expansion chamber.

12. A rotary compressor, comprising:

a compression chamber;

a rotatable shaft disposed within the compression chamber;

a roller disposed on the shaft in contact with a wall of the compression chamber;

a partition contacting the wall of the compression chamber and the roller, the partition defining a low pressure portion and a high pressure portion within the compression chamber;

a suction channel in fluid communication with the low pressure portion for providing fluid to the compression chamber at a suction pressure;

a discharge channel in fluid communication with the high pressure portion for removing fluid from the compression chamber at a discharge pressure;

a re-expansion port in the wall of the compression chamber; and a closed-ended re-expansion chamber connected to the re-expansion port.

13. The rotary compressor of claim 12, further comprising:

a valve adjacent to the re-expansion port movable between a first position allowing fluid communication between the compression chamber and the re-expansion chamber and a second position preventing fluid communication between the compression chamber and the re-expansion chamber.

14. The rotary compressor of claim 13, wherein the valve is moved in response to a parameter internal to the compressor.

15. The rotary compressor of claim 14, wherein the parameter is fluid pressure.

16. The rotary compressor of claim 14, wherein the valve comprises a sliding element biased to the first position.

17. The rotary compressor of claim 16, wherein the sliding element moves to the second position when exposed to a predetermined fluid pressure.

18. The rotary compressor of claim 17, wherein the predetermined fluid pressure is a predetermined discharge pressure.

19. The rotary compressor of claim 13, wherein the valve is moved in response to a parameter internal or external to the compressor.

20. The rotary compressor of claim 19, wherein the valve comprises:

a sliding element;

a solenoid to move the sliding element in response to a control signal; and a control device to sense the parameter and generate the control signal.

21. The rotary compressor of claim 20, wherein the parameter is fluid pressure.

22. The rotary compressor of claim 21, wherein the fluid pressure is the discharge pressure of the compressor.

23. The rotary compressor of claim 21, wherein the fluid pressure is the suction pressure of the compressor.

24. The rotary compressor of claim 20, wherein the parameter is temperature.

25. The rotary compressor of claim 20, wherein the control device is a thermostat.

26. The rotary compressor of claim 13, wherein the valve comprises:

a sliding element;

a solenoid to move the sliding element in response to a control signal;

a control device; and a switch associated with the control device, wherein actuation of the switch causes the control device to generate the control signal.

27. A rotary compressor, comprising:

a compression chamber;

a rotatable shaft disposed within the compression chamber;

a roller disposed on the shaft in contact with a wall of the compression chamber;

a partition contacting the wall of the compression chamber and the roller, the partition defining a low pressure portion and a high pressure portion within the compression chamber;

a suction channel in fluid communication with the low pressure portion for providing fluid to the compression chamber at a suction pressure;

a discharge channel in fluid communication with the high pressure portion for removing fluid from the compression chamber at a discharge pressure;

a re-expansion port in the wall of the compression chamber;

a re-expansion chamber connected to the re-expansion port;

a valve adjacent to the re-expansion port movable between a first position allowing fluid communication between the compression chamber and the re-expansion chamber and a second position preventing fluid communication between the compression chamber and the re-expansion chamber;

a second re-expansion port in the wall of the compression chamber;

a second re-expansion chamber connected to the second re-expansion port; and a valve adjacent to the second re-expansion port movable between a first position allowing fluid communication between the compression chamber and the second re-expansion chamber and a second position preventing fluid communication between the compression chamber and the second re-expansion chamber.

28. A rotary compressor with a capacity modulation system, the compressor comprising:

a substantially cylindrical compression chamber;

a rotatable shaft disposed within the compression chamber;

a roller eccentrically disposed on the shaft in contact with a wall of the compression chamber;

a vane disposed between the wall of the compression chamber and the roller, the vane defining a low pressure portion and a high pressure portion within the compression chamber;

a suction channel in fluid communication with the low pressure portion for providing fluid to the compression chamber at a suction pressure;

a discharge channel in fluid communication with the high pressure portion for removing fluid from the compression chamber at a discharge pressure;

a re-expansion channel adjacent to the compression chamber, the re-expansion channel having an end forming a re-expansion port in the wall of the compression chamber;

a closed-ended re-expansion chamber connected to the re-expansion channel; and a valve disposed in the re-expansion channel movable between a first position, in which the valve allows fluid communication between the compression chamber and the re-expansion chamber, and a second position, in which the valve prevents fluid communication between the compression chamber and the re-expansion chamber.

29. The rotary compressor of claim 28, wherein the valve comprises a sliding element biased to the first position.

30. The rotary compressor of claim 29, wherein the sliding element moves to the second position in response to a parameter internal to the compressor.

31. The rotary compressor of claim 30, wherein the parameter is the fluid discharge pressure of the compressor.

32. The rotary compressor of claim 29, further comprising:

a flow channel communicating the discharge channel with the re-expansion channel such that fluid at discharge pressure acts on a surface of the sliding element to move the sliding element to the second position.

33. The rotary compressor of claim 28, wherein the valve comprises:

a sliding element;

a solenoid to move the sliding element in response to a control signal; and a control device to sense a parameter internal or external to the compressor and generate the control signal.

34. The rotary compressor of claim 33, wherein the parameter is the fluid discharge pressure of the compressor.

35. The rotary compressor of claim 33, wherein the parameter is the fluid suction pressure of the compressor.

36. The rotary compressor of claim 33, wherein the parameter is temperature.

37. The rotary compressor of claim 28, wherein the valve comprises:

a sliding element;

a solenoid to move the sliding element in response to a control signal;

a control device; and a switch associated with the control device, wherein actuation of the switch causes the control device to generate the control signal.

38. A rotary compressor with a capacity modulation system, the compressor comprising:

a substantially cylindrical compression chamber;

a rotatable shaft disposed within the compression chamber;

a roller eccentrically disposed on the shaft in contact with a wall of the compression chamber;

a vane disposed between the wall of the compression chamber and the roller, the vane defining a low pressure portion and a high pressure portion within the compression chamber;

a suction channel in fluid communication with the low pressure portion for providing fluid to the compression chamber at a suction pressure;

a discharge channel in fluid communication with the high pressure portion for removing fluid from the compression chamber at a discharge pressure;

a re-expansion channel adjacent to the compression chamber, the re-expansion channel having an end forming a re-expansion port in the wall of the compression chamber;

a re-expansion chamber connected to the re-expansion channel;

a valve disposed in the re-expansion channel movable between a first position, in which the valve allows fluid communication between the compression chamber and the re-expansion chamber, and a second position, in which the valve prevents fluid communication between the compression chamber and the re-expansion chamber;

a second re-expansion channel adjacent to the compression chamber, the second re-expansion channel having an end forming a second re-expansion port in the wall of the compression chamber;

a second re-expansion chamber connected to the second re-expansion channel; and a valve disposed in the second re-expansion channel movable between a first position, in which the valve allows fluid communication between the compression chamber and the second re-expansion chamber, and a second position, in which the valve prevents fluid communication between the compression chamber and the second re-expansion chamber.

39. A method of modulating the capacity of a rotary or swing link compressor including a compression chamber and a rotary compressing member in the compression chamber, the method comprising:

supplying fluid to the compression chamber through an inlet port;

providing the compressor with a re-expansion chamber;

providing a flow path between the compression chamber and the re-expansion chamber, the flow path being positioned at a location spaced from the inlet port;

operating the compressor in a reduced capacity mode, comprising:

opening the flow path;

compressing fluid in the compression chamber and the re-expansion chamber;

withdrawing compressed fluid from the compression chamber through a discharge port; and allowing compressed fluid in the re-expansion chamber to return to the compression chamber through the re-expansion port;

supplying additional fluid to the compression chamber through the inlet port; and operating the compressor in a full capacity mode, comprising:

closing the flow path;

compressing the fluid in the compression chamber; and withdrawing the compressed fluid from the compression chamber through the discharge port.

40. The method of claim 39, wherein opening and closing the flow path are carried out using a valve.

41. The method of claim 40, wherein the valve comprises a sliding element.

42. The method of claim 41, wherein closing the flow path comprises exposing a surface of the sliding element to a fluid pressure.

43. The method of claim 42, wherein the fluid pressure is the discharge pressure of the compressor.

44. The method of claim 40, wherein the valve comprises:

a movable valve element; and a solenoid to move the valve element in response to a control signal.

45. The method of claim 44, further comprising:

a control device to sense a parameter internal or external to the compressor and generate the control signal.

46. The method of claim 45, wherein opening and closing the flow path comprise:

sensing the parameter with the control device;

generating a control signal with the control device; and actuating the solenoid in response to the control signal to move the valve element.

47. The method of claim 46, wherein the parameter is the fluid discharge pressure of the compressor.

48. The method of claim 46, wherein the parameter is the fluid suction pressure of the compressor.

49. The method of claim 46, wherein the parameter is temperature.

50. The method of claim 44, further comprising:

a control device; and a switch associated with the control device, wherein actuation of the switch causes the control device to generate the control signal.

51. The method of claim 39, further comprising:

providing the compressor with a second re-expansion chamber;

providing a flow path between the compression chamber and the second re-expansion chamber, the flow path being positioned at a second location spaced from the inlet port;

supplying fluid to the compression chamber through the inlet port; and operating the compressor at a first intermediate capacity level, comprising:

closing the flow path between the compression chamber and the re-expansion chamber;

opening the flow path between the compression chamber and the second re-expansion chamber;

compressing fluid in the compression chamber and the second re-expansion chamber;

withdrawing compressed fluid from the compression chamber through the discharge port; and allowing compressed fluid in the second re-expansion chamber to return to the compression chamber.

52. The method of claim 51, further comprising:

supplying fluid to the compression chamber through the inlet port; and operating the compressor at a second intermediate capacity level, comprising:

opening the flow path between the compression chamber and the re-expansion chamber;

closing the flow path between the compression chamber and the second re-expansion chamber;

compressing fluid in the compression chamber and the re-expansion chamber;

withdrawing compressed fluid from the compression chamber through the discharge port; and allowing compressed fluid in the re-expansion chamber to return to the compression chamber.

* * * * *